US006798124B2

(12) United States Patent
Hiramatsu

(10) Patent No.: US 6,798,124 B2
(45) Date of Patent: Sep. 28, 2004

(54) STRUCTURE OF SPARK PLUG DESIGNED TO PROVIDE HIGH THERMAL RESISTANCE AND DURABILITY

(75) Inventor: Hiromi Hiramatsu, Kariya (JP)

(73) Assignee: Denso Corporation (JP)

( * ) Notice: Subject to any disclaimer, the term of this patent is extended or adjusted under 35 U.S.C. 154(b) by 234 days.

(21) Appl. No.: 10/046,969

(22) Filed: Jan. 17, 2002

(65) Prior Publication Data

US 2002/0093277 A1 Jul. 18, 2002

(30) Foreign Application Priority Data

Jan. 18, 2001 (JP) ..... 2001-010677
Oct. 3, 2001 (JP) ..... 2001-307683

(51) Int. Cl.[7] ..... H01T 13/20; H01T 13/32
(52) U.S. Cl. ..... 313/141; 313/118
(58) Field of Search ..... 313/118, 135, 313/138, 141, 142, 143, 137; 123/169 R, 169 EL

(56) References Cited

U.S. PATENT DOCUMENTS 4,700,103 A 10/1987 Yamaguchi et al.
6,724,132 B2 * 4/2004 Kanao ..... 313/141
2002/0067111 A1 * 6/2002 Shibata et al. ..... 313/141

FOREIGN PATENT DOCUMENTS

EP 1383214 A2 * 1/2004 ..... H01T/13/32
JP 61-45583 3/1987
JP 2001307857 A * 11/2001 ..... H01T/13/20
WO WO 99/45615 9/1999

* cited by examiner

*Primary Examiner*—Nimeshkumar D. Patel
*Assistant Examiner*—Karabi Guharay
(74) *Attorney, Agent, or Firm*—Nixon & Vanderhye PC

(57) ABSTRACT

A spark plug is provided which consists of a center electrode retained within a metal shell and a ground electrode including a noble metal-made tip and a body joined to the metal shell. The noble metal-made tip is connected to the body through a fused portion that is a weld between the body and the noble metal-made tip. Portions of the noble metal-made tip and the fused portion closest to the tip of the center electrode are located within a range defined by a first line extending from the tip of the center electrode in a lateral direction of the center electrode and a second line extending from a portion of the center electrode closest to the ground electrode in a longitudinal direction of the center electrode so that they do not overlap with the tip of the center electrode both in the lateral and longitudinal directions of the center electrode.

12 Claims, 9 Drawing Sheets

STRUCTURE OF SPARK PLUG DESIGNED TO PROVIDE HIGH THERMAL RESISTANCE AND DURABILITY

BACKGROUND OF THE INVENTION

1. Technical Field of the Invention

The present invention relates generally to a spark plug which may be employed in automotive vehicles, gas pumps, and cogeneration systems, and more particularly to a spark plug which is so designed as to provide high thermal resistance and durability without sacrificing the ignitability of gaseous fuel.

2. Background Art

Typical spark plugs have a center electrode installed in a metal shell through an electric insulator and a ground electrode joined to the metal shell. The ground electrode faces the tip of the center electrode through an air gap (also called a spark gap) in which a sequence of sparks are produced.

In recent years, spark plugs are used which have a noble metal chip welded to an end of the ground electrode exposed to the spark gap in order to prolong the service life and improve the performance of the spark plug. The noble metal chip is made from, for example, Pt (Platinum) or Ir (Iridium) which is excellent in wear resistance. This type of spark plug, however, encounters a drawback in that a fused portion that is a weld between the noble metal chip and the ground electrode exists near the spark gap, so that it is subjected to intense heat within a combustion chamber of the engine, thereby resulting in great wear of the fused portion. In the worst case, it results in dislodgement of the noble metal chip from the ground electrode and an increase in spark gap.

SUMMARY OF THE INVENTION

It is therefore a principal object of the invention to avoid the disadvantages of the prior art.

It is another object of the invention to provide a spark plug designed to provide higher thermal resistance and durability without sacrificing the ignitability of a gaseous fuel.

According to one aspect of the invention, there is provided a spark plug which may be employed in automotive vehicles, gas pumps, and cogeneration systems and which is so designed as to provide higher durability and productivity. The spark plug comprises: (a) a metal shell; (b) a center electrode retained within the metal shell to be insulated from the metal shell, the center electrode having a given length and a tip projecting from the metal shell; and (d) a ground electrode including a noble metal-made tip and a body, the body being joined to the metal shell outside the center electrode in a lateral direction of the spark plug. The noble metal-made tip is connected to the body through a fused portion formed by materials of the body and the noble metal-made tip melted together and extends toward the center electrode to define a spark gap between the noble metal-made tip and the center electrode. If a portion of the noble metal-made tip of the ground electrode closest to the tip of the center electrode is defined as a ground electrode tip, and a portion of the fused portion closest to the tip of the center electrode is defined as a fused portion tip, the ground electrode tip and the fused portion tip are located within a range defined by a first line extending from the tip of the center electrode in a lateral direction of the center electrode and a second line extending from a portion of the center electrode closest to the ground electrode in a longitudinal direction parallel to a longitudinal center line of the center electrode so that the ground electrode tip and the fused portion tip do not overlap with the tip of the center electrode both in the lateral direction and in the longitudinal direction of the center electrode, thereby securing the stability of a sequence of sparks without sacrificing the growth of a flame kernel, which results in improved ignitability of fuel. The fused portion is not located on a line passing through the spark gap, thus avoiding the dislodgement of the noble metal-made tip from the body of the ground electrode due to spark-caused wear of the fused portion. The fused portion has a positional relation to the center electrode so that it does not overlap with the center electrode in a radial and vertical directions of the center electrode, thus avoiding the possibility of sparks occurring between a side wall of the center electrode and the fused portion, which minimizes the wear of the fused portion. This results in improved thermal resistance and durability of the ground electrode, which prolongs the service life of the spark plug.

In the preferred mode of the invention, a minimum distance between the fused portion tip and the tip of the center electrode is greater than the spark gap by 0.2 mm or more.

The noble metal-made tip of the ground electrode is made of a cylindrical member which has a diameter of 0.4 mm to 0.8 mm.

The noble metal-made tip of the ground electrode has a length projecting the fused portion which is between 0.3 mm and 1.0 mm.

The body of the ground electrode has a first portion and a second portion. The first portion is joined to same metal shell. The second portion extends from the first portion toward the longitudinal center line of the center electrode. A longitudinal center line of the second portion extends parallel to a longitudinal center line of the noble metal-made tip of the ground electrode.

The noble metal-made tip of the ground electrode is made of one of an Ir alloy and a Pt alloy.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

Figure 1:
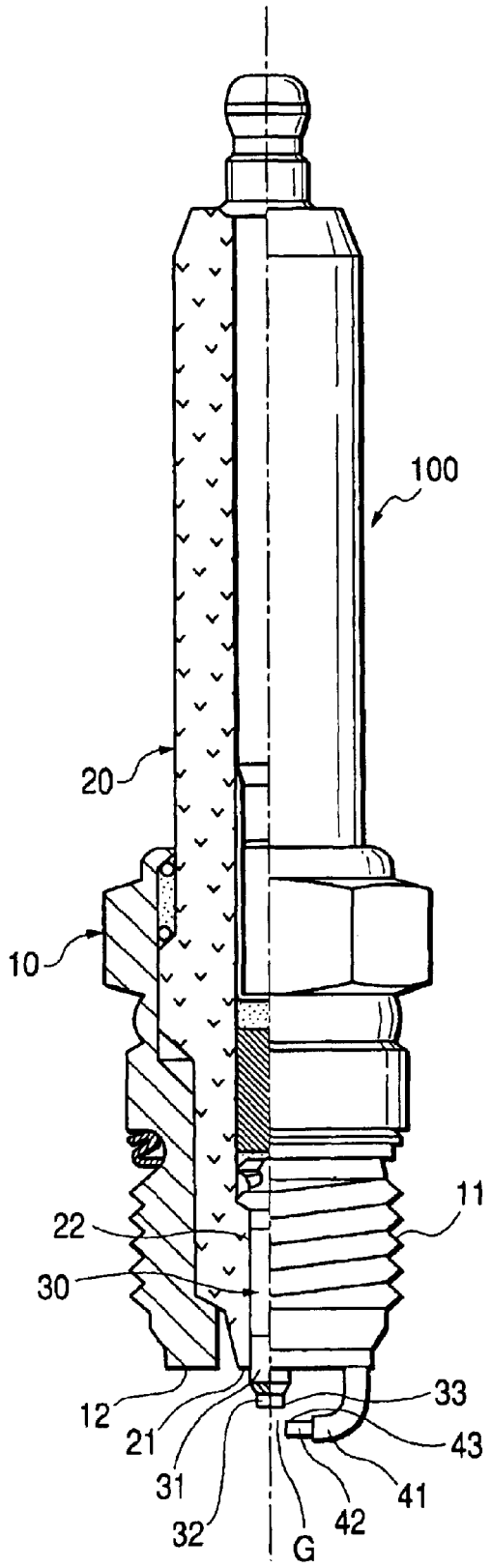
FIG. 1 is a partially sectional view which shows a spark plug having a positional relation of a ground electrode to a center electrode according to the invention.
Figure 2:
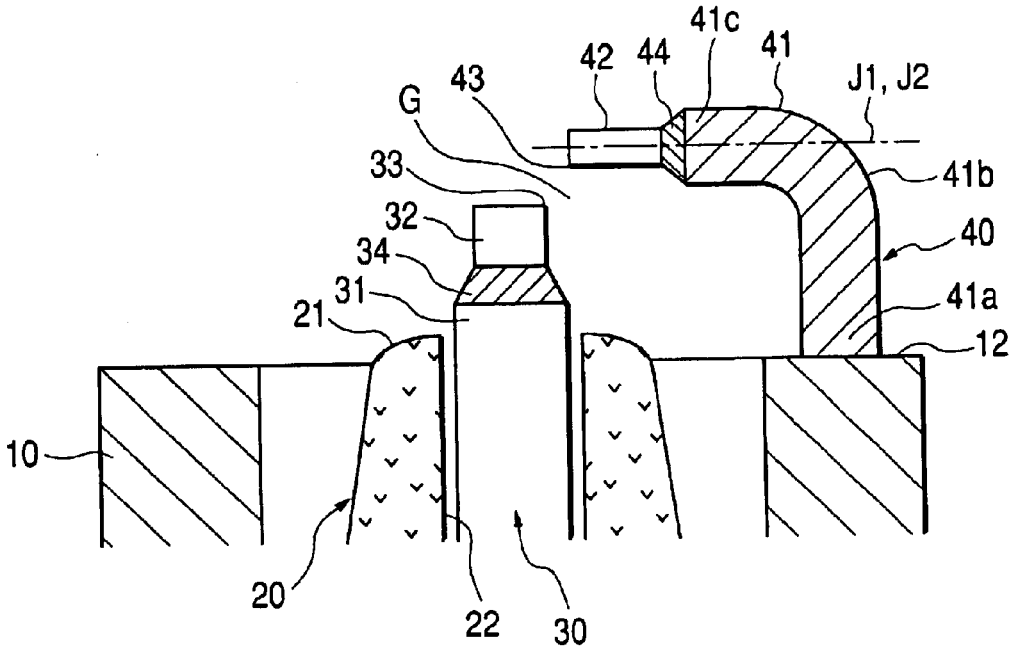
FIG. 2 is a partially enlarged view which shows a tip portion of the spark plug of FIG. 1.

Referring to the drawings, wherein like reference numbers refer to like parts in several views, particularly to FIG. 1, there is shown a spark plug 100 which may be used in automotive internal combustion engines or gas engines of generators in cogeneration systems. FIG. 2 is an enlarged view which shows a spark gap G (also called an air gap) of the spark plug 100.

The spark plug 100 includes a cylindrical metal housing or shell 10, a porcelain insulator 20, a center electrode 30, and a ground electrode 40. The metal shell 10 has cut therein a thread 11 for mounting the spark plug 100 in an engine block (not shown). The porcelain insulator 20 is made from an alumina ceramic ($Al_2O_3$) and retained within the metal shell 10. The porcelain insulator 20 has a tip 21 exposed outside an end of the metal shell 10.

The center electrode 30 is secured in a central chamber 22 of the porcelain insulator 20 and insulated electrically from the metal shell 10. The center electrode 30 has a tip 33 projecting from the tip 21 of the porcelain insulator 20. The center electrode 30 is made of a cylindrical body 31 and a noble metal-made tip 32 (will be referred to as a noble metal center electrode tip below). The cylindrical body 31 consists of a core portion made of a metallic material such as Cu having a higher thermal conductivity and an external portion made of a metallic material such as an Ni-based alloy having higher thermal and corrosion resistances. The noble metal center electrode tip 32 is of a disc shape and welded to an end of the body 31 to define the tip 33.

The ground electrode 40 is made of a cylindrical body 41 made of an Ni-based alloy or an Fe-based alloy and a noble metal-made cylindrical tip 42 (will referred to as a noble metal ground electrode tip below) joined to an end of the cylindrical body 41. The noble metal center electrode tip 32 and the noble metal ground electrode tip 42 are, as clearly shown in FIG. 2, laser-welded to the cylindrical bodies 31 and 41 to have welds 34 and 44 (will referred to as fused portions below), respectively. The fused portion 34 is formed by materials of the cylindrical body 31 and the noble metal center electrode tip 32 melted together by laser radiations. Similarly, the fused portion 44 is formed by materials of the cylindrical body 41 and the noble metal ground electrode tip 42 melted together by laser radiations.

Figure 3:
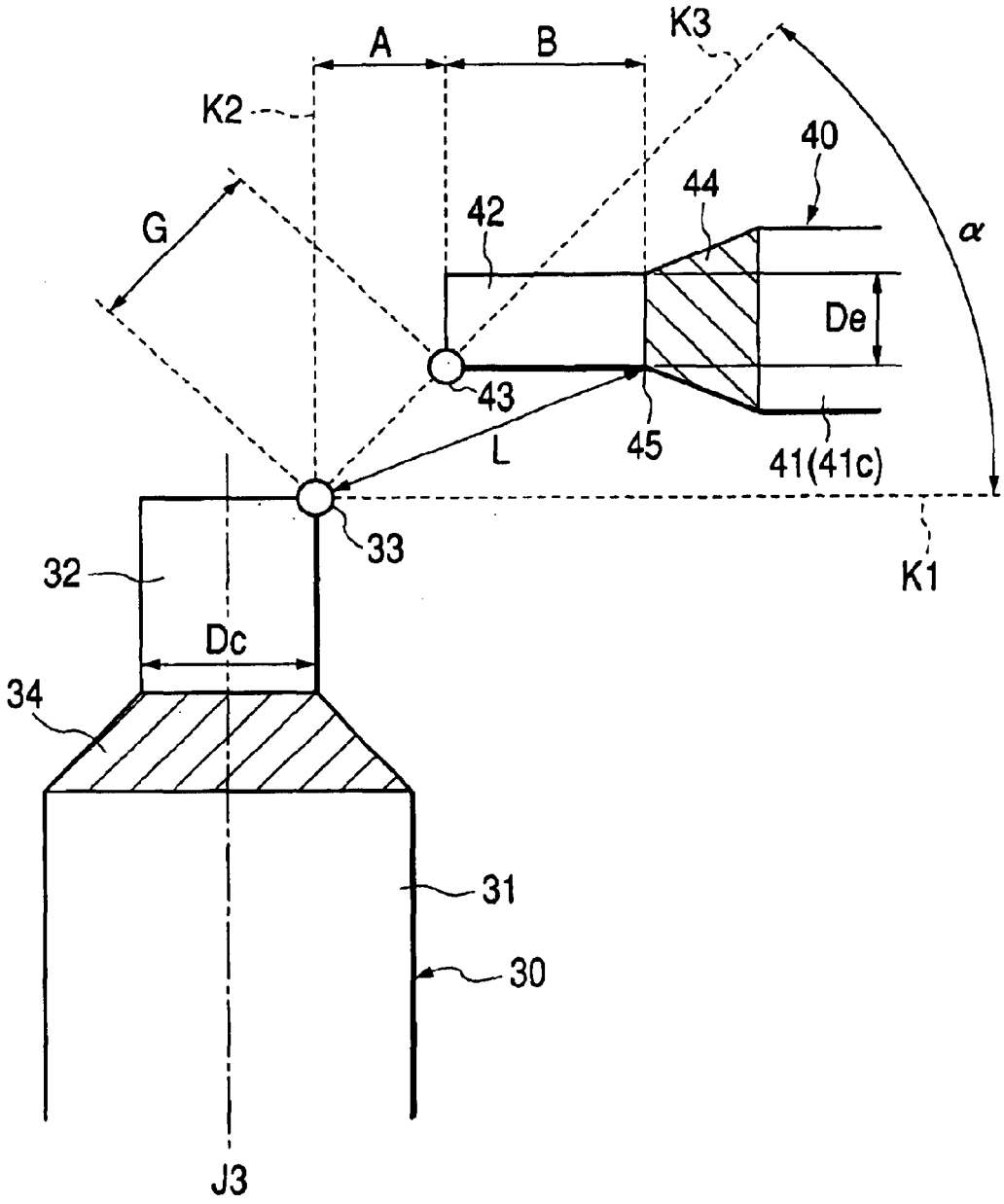
FIG. 3 is an illustration which shows a ground electrode positional range according to the invention.
Figure 5A:
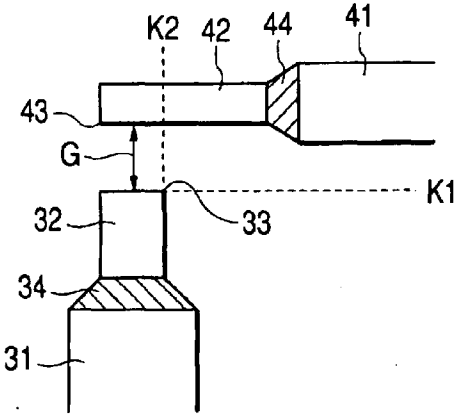
FIGS. 5(*a*), 5(*b*), 5(*c*), and 5(*d*) show spark plug samples used in tests to find a positional relation between a ground electrode and a center electrode for securing a desired ignitability without deterioration of the growth of a flame kernel.
Figure 5B:
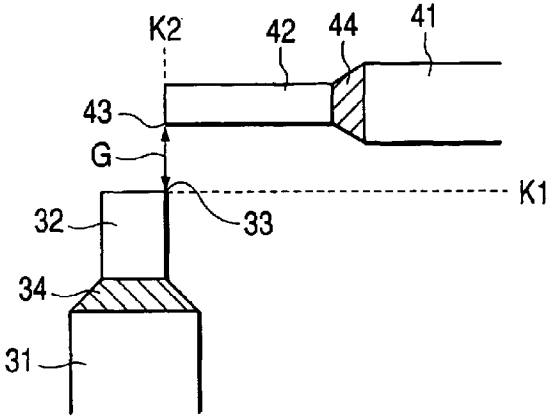
Figure 5C:
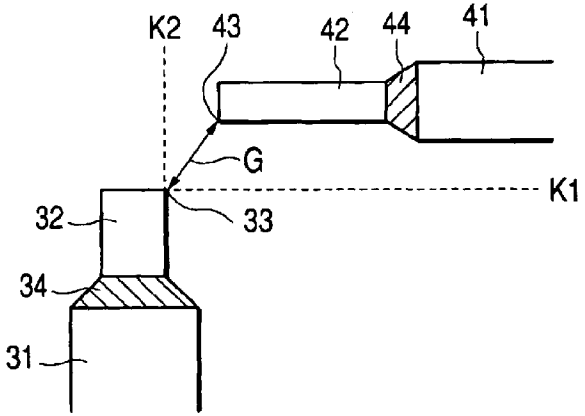
Figure 5D:
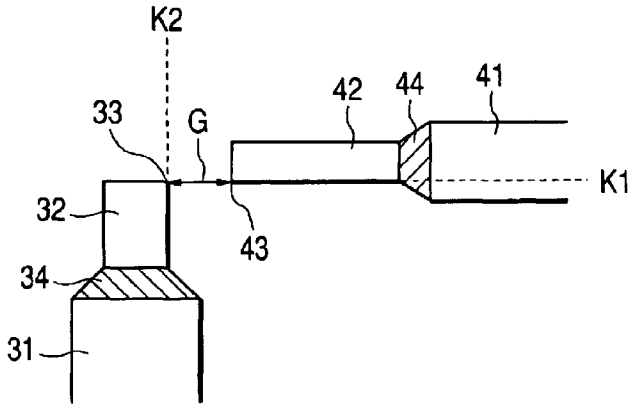

The cylindrical body 41 of the ground electrode 40 is secured on an end surface 12 of the metal shell 10 by welding and extends adjacent the center electrode 30. The cylindrical body 41 is, as clearly shown in FIG. 2, made of an L-shaped bar consisting of three portions: a base 41*a*, a central bend 41*b*, and a tip 41*c*. The base 41*a* is welded to the end surface 12 of the metal shell 10 and extends parallel to a longitudinal center line J3, as shown in FIG. 3, of the center electrode 30 (i.e., a length of the spark plug 100). The tip 41*c* is joined to the noble metal ground electrode tip 42 through the fused portion 44 and extends horizontally, as viewed in FIG. 2, from the central bend 41*b* perpendicular to the longitudinal center line J3 of the center electrode 30.

The noble metal ground electrode tip 42 extends perpendicular to the longitudinal center line J3 of the center electrode 30 to have a corner or edge 43 facing a corner or edge 33 of the center electrode 30. Specifically, the tip 41*c* that is a portion of the cylindrical body 41 extending from the bend 41*b* to the fused portion 44 has a longitudinal center line J2 extending perpendicular to the longitudinal center line J3 of the center electrode 30. The noble metal ground electrode tip 42 has a longitudinal center line J1 which extends parallel to the longitudinal center line J2 of the tip 41*c* of the cylindrical body 40 (in this embodiment, the line J1 is aligned with the line J2).

The spark gap G is produced between opposed portions of corners of the noble metal ground electrode tip 42 and the noble metal center electrode tip 32. In the following discussion, the opposed portions, as illustrated by circles in FIG. 3, of the corners of the noble metal ground electrode tip 42 and the noble metal center electrode tip 32 located at the shortest interval away from each other will be referred to as the edges 43 and 33 below for convenience of explanation. Additionally, a portion of a tip corner of the fused portion 44 of the ground electrode 40 located closest to the edge 33 of the noble metal center electrode 32 will be referred to as an edge 45 of the fused portion 44 below.

The noble metal center electrode tip 32 and the noble metal ground electrode tip 42 may be made of an Ir alloy or a Pt alloy. The Ir alloy preferably contains 50 Wt % or more of Iridium (Ir). For example, a material containing a main component of more than 50 Wt % of Ir and an additive of at least one of Rh (rhodium), Pt (platinum), Ru (ruthenium), Pd (palladium), and W (tungsten) (e.g., an Ir- 10Rh containing 90 Wt % of Ir and 10 Wt % of Rh) may be used.

Referring to FIG. 3, a broken line K1 is an imaginary line (will be referred to as a first imaginary line below) extending from the edge 33 of the noble metal center electrode tip 32 in a radial direction of the center electrode 30 (i.e., the spark plug 100). A broken line K2 is an imaginary line (will be referred to as a second imaginary line below) extending from the edge 33 of the noble metal center electrode tip 32 in a longitudinal direction of the center electrode 30. A indicates a distance between the edges 33 and 43 of the center electrode 30 and the ground electrode 40 in the radial direction of the center electrode 30 (i.e., the spark plug 100). B indicates a length of the noble metal ground electrode 42. G indicates an interval between the edges 33 and 43 of the center electrode 30 and the ground electrode 40 (i.e., the spark gap). Dc indicates the diameter of the noble metal center electrode tip 32. De indicates the diameter of the noble metal ground electrode tip 42. L indicates a minimum distance between the edge 33 of the noble metal center electrode tip 32 and the edge 45 of the fused portion 44. $\alpha$ indicates an angle which a broken line K3 (will be referred to as a third imaginary line below) passing through the edges 33 and 43 of the center and ground electrodes 30 and 40 makes with the first imaginary line K1.

This embodiment has a principal feature that the edge 43 of the noble metal ground electrode 42 is located within a range (will be referred to as a ground electrode location range below) defined inside the imaginary lines K1 and K2 so that it does not overlap with the noble metal center electrode tip 32 in vertical and horizontal directions, as viewed in FIG. 3. In other words, the edges 33 and 42 of the center and ground electrodes 30 and 40 are disposed to have a positional relation in which the distance A between the edges 33 and 42 is more than zero (0), and the angle α between the imaginary lines K1 and K3 between 0° and 90°.

The above positional relation between the edges 33 and 42 is established based on the fact that if the edge 33 of the noble metal center electrode tip 32 overlaps with the noble metal ground electrode tip 42 in the vertical and horizontal directions, as viewed in FIG. 3, it may cause the growth of a flame kernel produced in the spark gap G to be checked by the noble metal ground electrode tip 42, thereby lowering the ignitability of a mixture within a combustion chamber of the engine. The fact has been found by researches, as discussed below, made by the inventor of this application.

The inventor performed the following ignitability tests to find a positional relation between the noble metal ground electrode tip 42 and the center electrode 30 required for securing a desired ignitability without sacrificing the growth of a flame kernel in terms of limits: the first and second imaginary lines K1 and K2.

Figure 4:
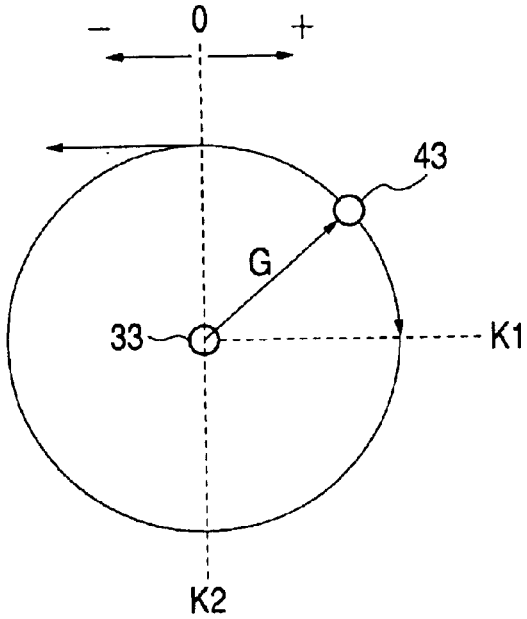
FIG. 4 is an illustration which shows a positional relation of a tip of a ground electrode to a tip of a center electrode of each spark plug sample used in tests.

First, spark plug samples were prepared in which the edge 43 of the noble metal ground electrode tip 42 had positional relations, as defined on a thick solid line on a circle in FIG. 4, to the edge 33 of the noble metal center electrode tip 32. The circle has the radius equivalent to the spark gap G and the center defined on the edge 33 of the noble metal center electrode tip 32. The thick solid line is defined by the distance A between the edges 33 and 43 in the radial direction of the center electrode 30 which changes as a function of the angle α. When a line passing through the edges 33 and 43 coincides with the second imaginary line K2, the distance A will be zero (0). When the edge 43 of the noble metal ground electrode tip 42 is located outside the second imaginary line K2 above the noble metal center electrode tip 32, the distance A has a negative value. When the edge 43 of the noble metal ground electrode tip 42 is located inside the second imaginary line K2, that is, on the right side of the second imaginary line K2 in FIG. 3, the distance A has a positive value.

The spark plug samples have different values of the distance A as a function of the angle α. The distance A when the edge 43 of the noble metal ground electrode 42 is located within the ground electrode location range defined inside the first and second imaginary lines Kl and K2 has values where the spark gap G is constant. The distance A when the edge 43 is located outside the ground electrode location range has values along a tangent of the circle of FIG. 4.

FIGS. 5(*a*) to 5(*d*) illustrate, as examples, some of the spark plug samples used in the ignitability tests. The spark plug sample of FIG. 5(*a*) has a positional relation of the edge 43 to the edge 33 (will also be referred to as a ground-to-center electrode relation below) in which the distance A has a negative value in FIG. 4. Specifically, the edge 43 of the noble metal ground electrode 42 is located outside the ground electrode location range. The spark plug sample of FIG. 5(*b*) has a ground-to-center electrode positional relation in which the distance A is zero (0). The spark plug sample of FIG. 5(*c*) has a ground-to-center electrode positional relation in which the distance A has a positive value which is smaller than the distance of the spark gap G (α=90°). The spark plug sample of FIG. 5(*d*) has a ground-to-center electrode positional relation in which the distance A has a positive value which is equal to the distance of the spark gap G (α=0). The spark plug samples of FIGS. 5(*b*), 5(*c*), and 5(*d*) have the ground-to-center electrode positional relations within the ground electrode location range defined in this embodiment.

Figure 6:
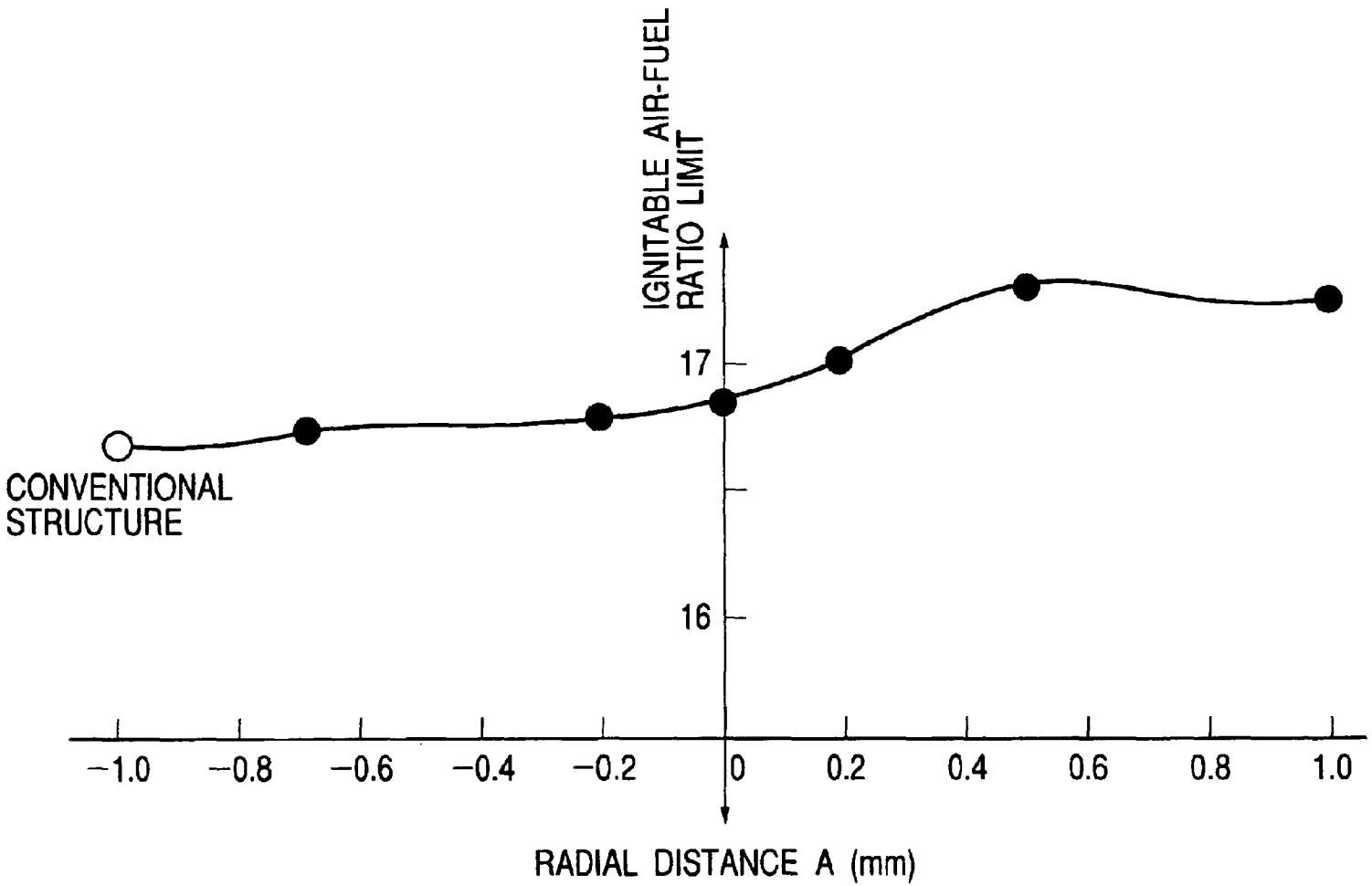
FIG. 6 is a graph which shows a relation between a minimum distance between edges of a ground and a center electrode and an ignitable air-fuel ration limit in each spark plug sample.

The inventor, as described above, performed the ignitability texts using the spark plug samples having different ground-to-center electrode positional relations of the edge 43 to the edge 33. The ignitability texts were achieved by installing each of the spark plug samples in a 4-cylinder 1.6-liter internal combustion engine, running the engine at 650 rpm, and increasing an air-fuel ratio of a mixture from one in an idle mode of engine operation to detect misfires. The air-fuel ratio when two or more misfires occurs for two minutes is determined as an ignitable air-fuel ratio limit. The results of the texts are shown in FIG. 6. In the spark plug samples, the spark gap G was 1.0 mm. The diameter Dc of the noble metal center electrode tip 32 was 0.7 mm. The diameter De of the noble metal ground electrode tip 42 was 0.4 mm.

The spark plug samples having greater ignitable air-fuel ratio limits are excellent in ignition performance and capable of igniting a lean mixture. In FIG. 6, the spark plug sample, as expressed by a white circle, whose distance A is −1.0 mm has the ground-to-center electrode positional relation, as illustrated in FIG. 5(*a*), which is out of the ground electrode location range defined in this embodiment. The spark plug sample whose distance A is 1.0 mm has the ground-to-center electrode positional relation, as illustrated in FIG. 5(*d*). The graph of FIG. 6 shows that the spark plug samples having positive values of the distance A are higher in ignitability than those having negative values of the distance A.

It has also been found that the spark plug sample in which the edge 43 of the noble metal ground electrode tip 42 is located outside the first imaginary line Kl above the center electrode 30 (i.e., α>90°) may create the spark gap between a side surface of the noble metal center electrode tip 32 and the edge 43 of the noble metal ground electrode tip 42, which causes a spark to be produced on the fused portion 34 of the center electrode 30 and that it is important not to locate the edge 43 of the noble metal ground electrode tip 42 beyond the imaginary line Kl toward the center electrode 30.

Specifically, the spark plug samples, as shown in FIGS. 5(*b*) to FIG. 5(*d*), in which the edge 43 of the noble metal ground electrode tip 42 lies within the ground electrode location range defined inside the imaginary lines K1 and K2 so that it does not overlap with the noble metal center electrode tip 32 in longitudinal and radial directions of the center electrode 30 (i.e., the distance A≧0, and 0≦α≦90°) are capable of producing a sequence of sparks without obstructing the growth of a flame kernel, which results in improved ignitability as compared with the comparative spark plug sample as shown in FIG. 5(*a*).

The diameter De of the noble metal ground electrode tip 42 is preferably between 0.4 mm and 0.8 mm. The length B thereof is preferably between 0.3 mm and 1.0 mm. These dimensional ranges are established based on the following researches made by the inventor of this application.

In general, the thinner the noble metal ground electrode tip 42, the lower the possibility that a flame kernel hits the noble metal ground electrode tip 42. The inventor, thus, prepared spark plug samples having different values of the diameter De of the noble metal ground electrode tip 42 and performed the same tests as described above. The test results are shown in FIG. 7.

Figure 7:
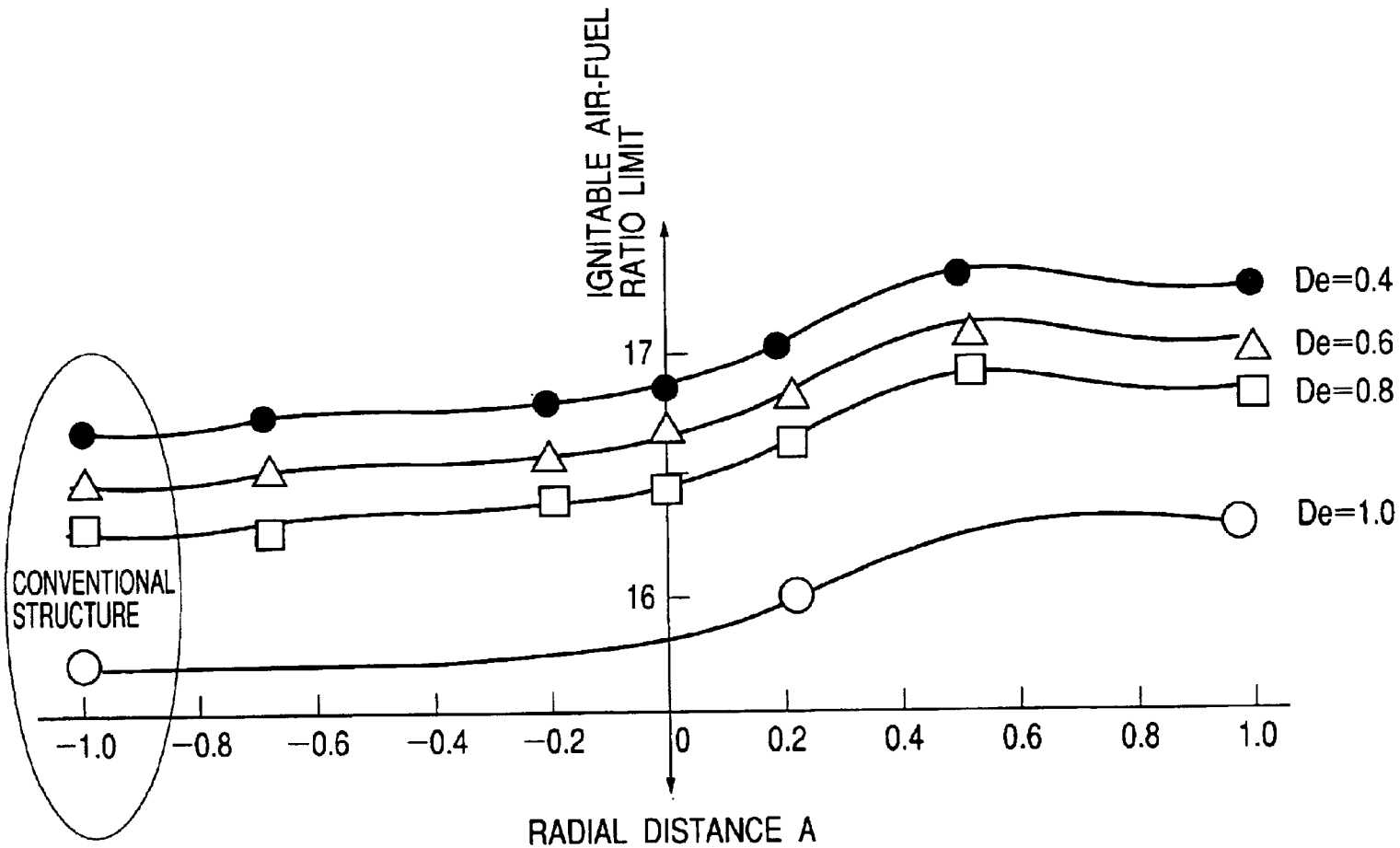
FIG. 7 is a graph which shows relations between a minimum distance between edges of a ground and a center electrode and an ignitable air-fuel ration limit in spark plug samples for different values of diameter De of a noble metal ground electrode tip.

The diameters De of the spark plug samples used in the tests are, as shown in FIG. 7, 0.4 mm, 0.6 mm, 0.8 mm, and 1.0 mm. The graph of FIG. 7 represents the distance A-to-ignitable air-fuel ratio limit relations of the spark plug samples. The graph shows that the smaller the diameter De of the noble metal ground electrode tip 42, the higher the ignitability of a mixture, however, in a case of a diameter De of 1 mm, the ignitability is reduced greatly.

The research made by the inventor showed that although the noble metal ground electrode tip 42 is excellent in thermal resistance and wear resistance, the diameter De less than 0.4 mm causes sparks to collect on the noble metal ground electrode tip 42, thus resulting in an increase in wear thereof. It has, therefore, been found that the diameter De of the noble metal ground electrode tip 42 is preferably between 0.4 mm and 0.8 mm for securing stable ignitability.

In this embodiment, the diameter De of the noble metal ground electrode tip 42 is smaller than the diameter Dc of the noble metal center electrode tip 32 for securing the growth of a flame kernel.

Further, the smaller the length B of the noble metal ground electrode tip 42, the closer to the spark gap G the cylindrical body 41 of the ground electrode 40 is. The cylindrical body 41 may be thought of as being a factor in obstructing the growth of a flame kernel contributing to the low ignitability. It is, thus, appreciated that the greater the length B of the noble metal ground electrode tip 42, the higher the ignitability.

The research made by the inventor shows that the ignitability is maximized when the length B of the noble metal ground electrode tip 42 is 0.3 mm. For instance, when the length B is between 0 and 0.3 mm, the ignitable air-fuel ratio limit is increased by as much as two (2), but when the length B is 0.3 mm or more, the ignitable air-fuel ratio limit is increased only by approximately 0.3.

It has also been found that that when the length B of the noble metal ground electrode tip 42 is greater than 1.0 mm, it results in a great rise in temperature of the end of the noble metal ground electrode tip 42, so that it is melted. Therefore, the length B is preferably between 0.3 mm and 1.0 mm in terms of the ignitability.

The fused portion 44 formed between the noble metal ground electrode tip 42 and the cylindrical body 41 is, as described above, located outside an extension line passing through the spark gap G, thereby avoiding the dislodgement of the noble metal ground electrode tip 42 due to spark-caused wear thereof, thus resulting in improved thermal resistance and durability of the ground electrode 40. This leads to an increased service lift of the spark plug 100.

Figure 10:
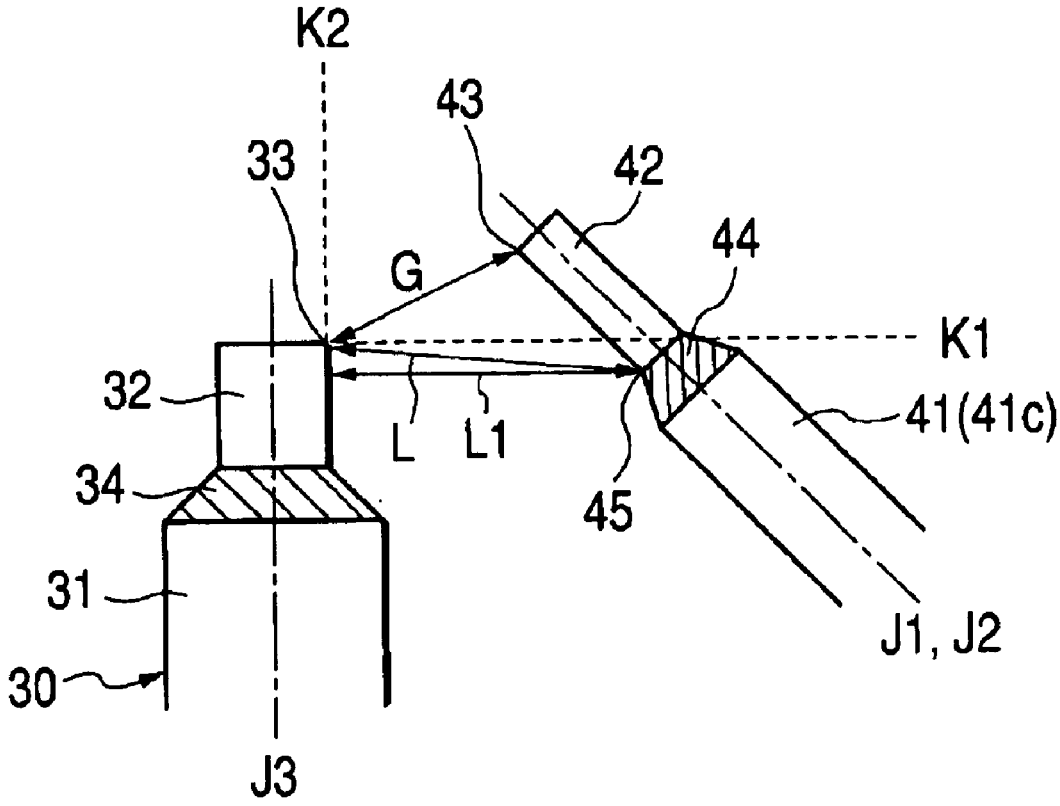
FIG. 10 shows a comparative spark plug as illustrated for structural comparison with a spark plug of the invention.

In a case where the edge 45 of the fused portion 44 of the ground electrode 40 is, as shown in a comparative example of FIG. 10, located below the first imaginary line K1 so that it overlaps with the center electrode 30 in the radial direction thereof, the distance L1 between the edge 45 of the noble metal ground electrode tip 42 and the side surface of the noble metal center electrode tip 32 is shorter than the minimum distance L between the edge 45 and the edge 33 of the noble metal center electrode tip 32, thus resulting in an increase in possibility of sparks occurring between the fused portion 44 and the side surface of the noble metal center electrode tip 32, which leads to increased wear of the fused portion 44. In the spark plug 100 of this embodiment, the edge 45 of the fused portion 44 of the ground electrode 40 is, as clearly shown in FIG. 3, located within the ground electrode location range defined between the first and second imaginary lines K1 and K2 so that it does not overlap with the noble metal center electrode tip 32 of the center electrode 30 in the radial and longitudinal directions of the center electrode 30, thereby avoiding the possibility of sparks occurring between the fused portion 44 and the side surface of the noble metal center electrode tip 32, which results in increases in thermal resistance and durability of the ground electrode 40. This increases the service life of the spark plug 100.

The minimum distance L between the edge 45 of the fused portion 44 of the ground electrode 40 and the edge 33 of the center electrode 30 is preferably greater than the spark gap G by 0.2 mm or more. This is based on the following researches made by the inventor of this application.

The inventor performed tests using spark plug samples having different values of the distance L and the spark gap G. The results of the tests are shown in a graph of FIG. 8.

Figure 8:
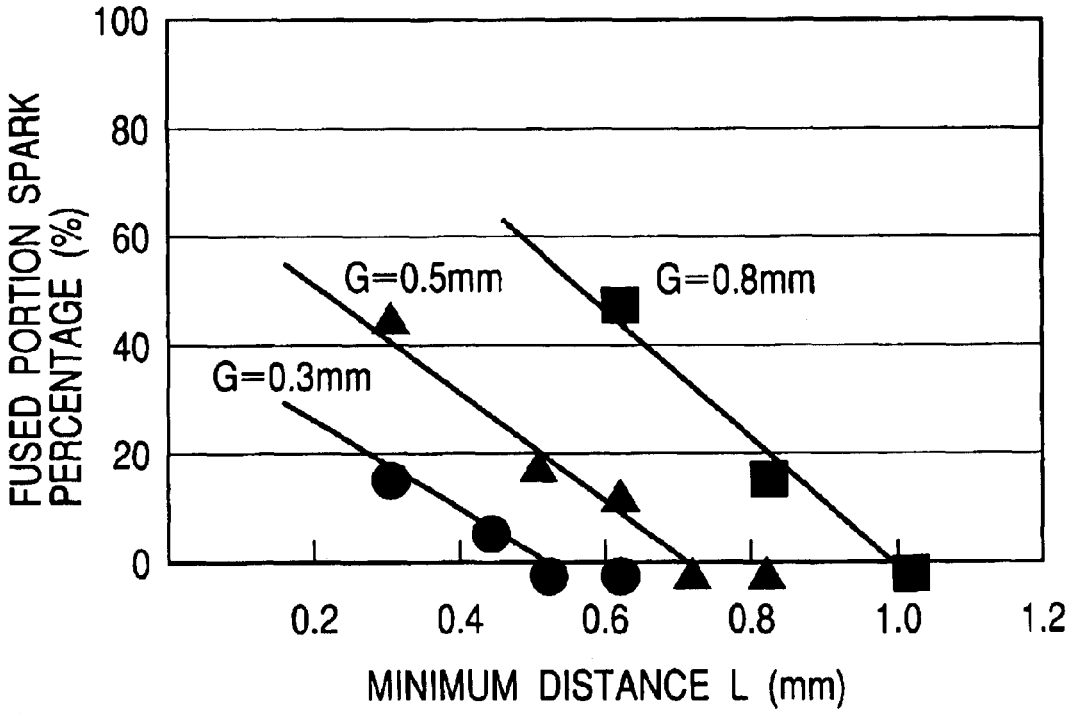
FIG. 8 is a graph which shows relations between a minimum distance between edges of a ground and a center electrode and a percentage of sparks occurring at a fused portion of the ground electrode in spark plug samples having different values of a spark gap.
Figure 9A:
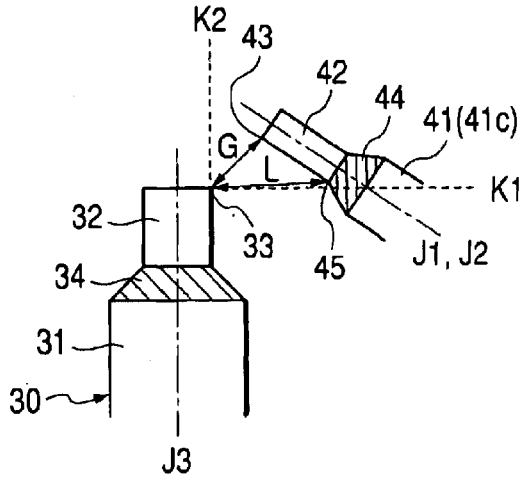
FIGS. 9(*a*), 9(*b*), 9(*c*), and 9(*d*) show modifications of a park plug of the invention.
Figure 9B:
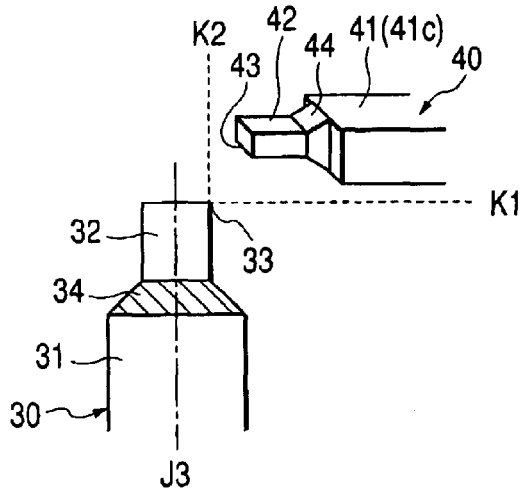
Figure 9C:
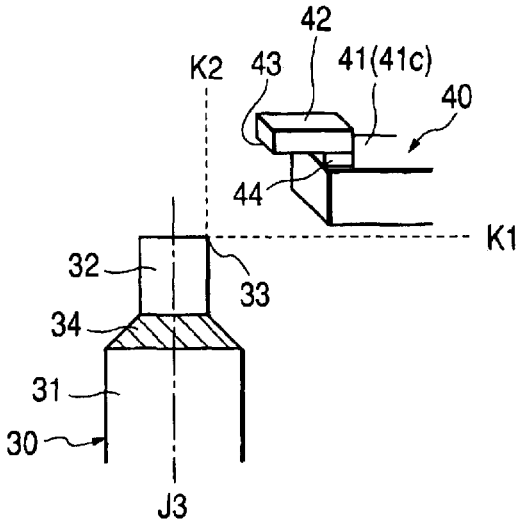
Figure 9D:
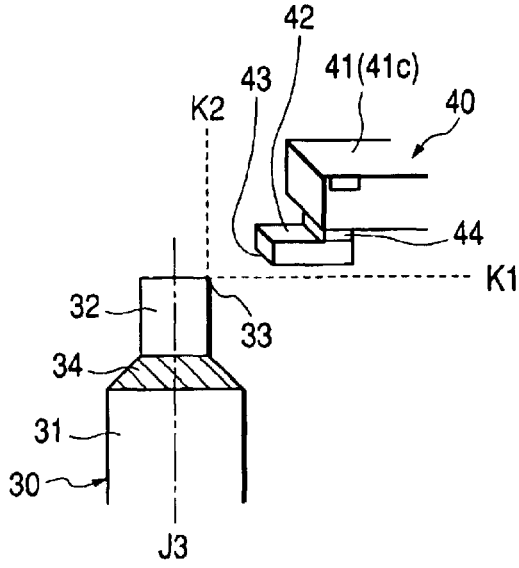

The noble metal ground electrode tip 42 and the noble metal center electrode tip 32 of the spark plug samples were made of the Ir-10Rh alloy. The percentage (%) of sparks produced between the fused portion 44 of the ground electrode 40 and the center electrode 30 was measured. The measurement was performed by installing each of the spark plug samples in a chamber, increasing the pressure in the chamber up to 0.6 MPa, and producing electric discharges or sparks. The graph of FIG. 8 represents relations between the minimum distance L and the percentage of sparks occurring at the fused portion 44 of the ground electrode 40 in the spark plug samples whose spark gap G is 0.3 mm, 0.5 mm, and 0.8 mm. Note that a spark percentage of, for example, 20% means that 20% of the sparks occurred at the fused portion 44, and 80% thereof occurred within the spark gap G.

The graph of FIG. 8 shows that in a case where the spark gap G is 0.3 mm, sparks are all produced within the spark gap G if the distance L is greater than or equal to 0.5 mm, in a case where the spark gap G is 0.5 mm, sparks are all produced within the spark gap G if the distance L is greater than or equal to 0.7 mm, and in a case where the spark gap G is 0.8 mm, sparks are all produced within the spark gap G if the distance L is greater than or equal to 1.0 mm. It is, thus, advisable that the minimum distance L between the edge 45 of the fused portion 44 of the ground electrode 40 and the edge 33 of the noble metal center electrode tip 32 of the center electrode 30 be greater than the spark gap G by 0.2 mm in order to eliminate undesirable sparks between the fused portion 44 and the edge 33 of the center electrode 30.

FIGS. 9(*a*) to 9(*d*) illustrate modifications of the spark plug 100.

In the spark plug of FIG. 2, the longitudinal center line J1 of the noble metal ground electrode tip 42 and the longitudinal center line J2 of the tip 41*c* of the cylindrical body 40 extend substantially perpendicular to the longitudinal center line of the spark plug 100 (i.e., the center electrode 30), however, they may, as shown in FIG. 9(*a*), extend diagonally upward.

The noble metal ground electrode tip 42 may be made of a square rod, as shown in FIGS. 9(*b*), 9(*c*), and 9(*d*). FIGS. 9(*b*) to 9(*d*) each illustrate the ground electrode 40 in perspective for ease of visibility.

The joint of the noble metal ground electrode tip 42 of the ground electrode 40 of each of the spark plugs in FIGS. 9(*b*) to 9(*d*) to the body 41 may be achieved by laser-welding the noble metal ground electrode tip 42 to a recess formed in the tip 41*c* of the body 41 or directly to the surface of the tip 41*c*.

While in each of the spark plugs of FIGS. 9(*c*) and 9(*d*), the longitudinal center lines of the noble metal ground electrode tip 42 and the cylindrical body 41 extend parallel to each other and not in alignment, the same effects as described above are obtained.

The noble metal ground electrode tip 42 may be joined to the body 41 by plasma arc welding or argon arc welding as well as laser welding. The same applies to the joint of the noble metal center electrode tip 32 to the body 31 of the center electrode 30.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. A spark plug comprising:

a metal shell;

a center electrode retained within said metal shell to be insulated from said metal shell, said center electrode having a given length and a tip projecting from said metal shell; and a ground electrode including a noble metal-made tip and a body, the body being joined to said metal shell outside said center electrode in a lateral direction of the spark plug, the noble metal-made tip being connected to the body through a fused portion formed by materials of the body and the noble metal-made tip melted together and extending toward said center electrode to define a spark gap between the noble metal-made tip and said center electrode, wherein if a portion of the noble metal-made tip of said ground electrode closest to the tip of said center electrode is defined as a ground electrode tip, and a portion of the fused portion closest to the tip of said center electrode is defined as a fused portion tip, said ground electrode tip and said fused portion tip are located within a range defined by a first line extending from a top end surface of the tip of said center electrode in a lateral direction of said center electrode and a second line extending from a portion of said center electrode closest to said ground electrode in a longitudinal direction parallel to a longitudinal center line of said center electrode so that said ground electrode tip and said fused portion tip do not overlap with the tip of said center electrode both In the lateral direction and in the longitudinal direction of said center electrode.

2. A spark plug as set forth in claim 1, wherein a minimum distance between the fused portion tip and the tip of said center electrode is greater than the spark gap by 0.2 mm or more.

3. A spark plug as set forth in claim 1, wherein the noble metal-made tip of said ground electrode is made of a cylindrical member which has a diameter of 0.4 mm to 0.8 mm.

4. A spark plug as set forth in claim 1, wherein said noble metal-made tip of said ground electrode has a length projecting the fused portion, the length being between 0.3 mm and 1.0 mm.

5. A spark plug as set forth in claim 1, wherein the body of said ground electrode has a first portion and a second portion, the first portion being joined to said metal shell, the second portion extending from the first portion toward the longitudinal center line of said center electrode, a longitudinal center line of the second portion extending parallel to a longitudinal center line of the noble metal-made tip of said ground electrode.

6. A spark plug as set forth in claim 1, wherein the noble metal-made tip of said ground electrode is made of one of an Ir alloy and a Pt alloy.

7. A spark plug as set forth in claim 1, wherein an entirety of said noble metal-made tip of said ground electrode is located within said range.

8. A spark plug as set forth in claim 1, wherein said fused portion is disposed entirely within said range.

9. A spark plug as set forth in claim 1, wherein the body of said ground electrode has a first portion and a second portion, the first portion being joined to said metal shell, the second portion extending from the first portion toward the longitudinal centerline of said center electrode, a longitudinal center line of the second portion being substantially perpendicular to the longitudinal center line of said center electrode.

10. A spark plug as set forth in claim 9, wherein the longitudinal center line of the second portion extends in parallel to a longitudinal center line of the noble metal-made tip of said ground electrode.

11. A spark plug as set forth in claim 9, wherein an entirety of said noble metal-made tip of said ground electrode Is located within said range.

12. A spark plug as set forth in claim 9, wherein said fused portion is disposed entirely within said range.

* * * * *